United States Patent [19]

Ritter

[11] 4,369,482

[45] Jan. 18, 1983

[54] ELECTROMAGNETIC RELAY

[75] Inventor: Heinz Ritter, Schongau, Fed. Rep. of Germany

[73] Assignees: SDS-Elektro GmbH, Deisenhofen, Fed. Rep. of Germany; Matsushita Electric Works, Ltd., Osaka, Japan

[21] Appl. No.: 273,140

[22] Filed: Jun. 12, 1981

[30] Foreign Application Priority Data

Jun. 27, 1980 [DE] Fed. Rep. of Germany ..... 3024343

[51] Int. Cl.[3] ..... H01H 47/36

[52] U.S. Cl. ..... 361/210; 361/156

[58] Field of Search ..... 361/156, 208, 209, 210

[56] References Cited

U.S. PATENT DOCUMENTS 3,258,646 6/1966 Fowler .
3,582,719 6/1971 Stuckens .

FOREIGN PATENT DOCUMENTS 905986 7/1949 Fed. Rep. of Germany ..... 361/209
1298626 7/1969 Fed. Rep. of Germany .
2749732 5/1979 Fed. Rep. of Germany .

OTHER PUBLICATIONS

"Der Elektromeister", 1960, vol. 22, pp. 1309–1311.

*Primary Examiner*—Harry E. Moose, Jr.
*Attorney, Agent, or Firm*—Schwartz, Jeffery, Schwaab, Mack, Blumenthal & Koch

[57] ABSTRACT

An electromagnetic relay adapted to be driven by a.c. voltage includes two windings formed by two wires wound together, each winding having its ends connected through diodes to a respective terminal of the a.c. voltage source. The diodes are connected to each terminal with opposite forward directions so that the magnetic fluxes generated by the two windings have the same direction irrespective of the polarity of the a.c. voltage. The capacity existing between the two windings acts as a reactance for limiting the exciting current without consuming active energy.

6 Claims, 5 Drawing Figures

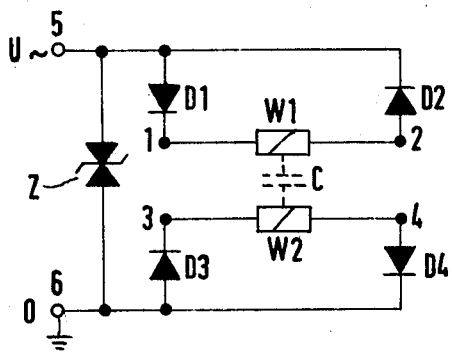
FIG. 1
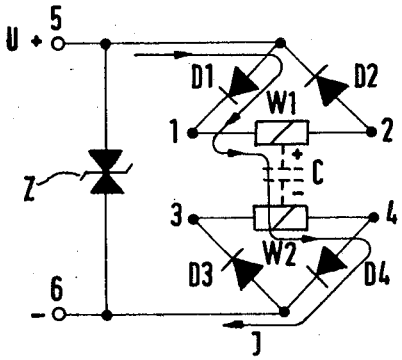
FIG. 2
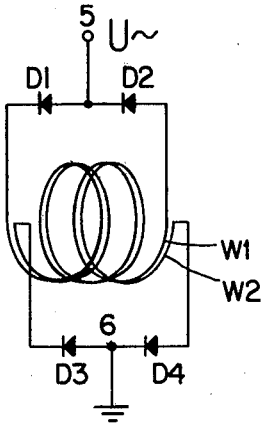
FIG. 5
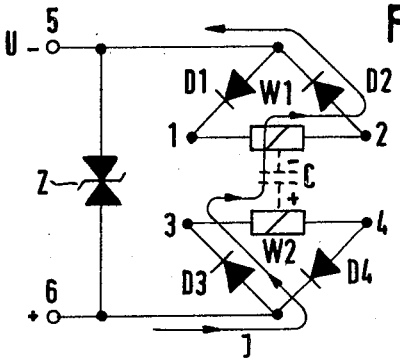
FIG. 3
FIG. 4
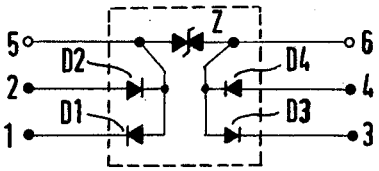

ELECTROMAGNETIC RELAY

BACKGROUND OF THE INVENTION

The present invention relates to an electromagnetic relay which is adapted to be driven by a.c. voltage.

In contrast to driving relays with d.c. voltage, the operation by means of a.c. voltage, particularly from the usual 110 or 220 V supplies, has been possible only with unpolarized relays of relatively large volume which can withstand coil losses of up to several watts at a coil volume of several cubic centimeters. Relays of this type are usually provided with a short-circuit ring to extend the drop-out time in such a manner that the relays neither de-energize nor oscillate during a.c. operation at for instance 50 Hz.

Polarized relays may be operated with a.c. voltage if a rectifier bridge or the like is used. The rectifying diodes act like quenching diodes, thereby extending the drop-out time of the relay by a factor of about 5. If it were desired to operate a relay of this type and of a reasonably small volume with an exciting energy of about 150 mW usual for polarized d.c. relays at an a.c. voltage of 220 V, such relay would require a coil resistance by far beyond what can be realized in practice.

If it is attempted to realize a maximum coil resistance in a modern relay, a maximum value of about 20 kΩ may be achieved by using the finest enameled copper wires which may be processed at reasonable expense. If such a relay were operated by an a.c. voltage of 220 V, 2.4 watts of electrical energy would be converted by the exciting coil into heat which would cause a rise in temperature of the relay by about 140° C. In order to avoid such unallowable heating, an ohmic resistance used will have to be provided as a separate circuit element which causes not only an increase in the assembly costs but also losses of 1 to 2 watts, thus increased space requirement, which is particularly disadvantageous in printed circuit-board structures.

German Auslegeschrift No. 1 298 626 discloses a relay having its coil connected via a diode bridge and a capacitor to an a.c. voltage source, the capacitor serving to limit the exciting current. While this capacitor takes up only reactive energy, and thus produces no heat, it again forms a separate circuit element which requires even more space and is therefore particularly disadvantageous in modern circuits of high packing density.

German Offenlegungsschrift No. 2 749 732 discloses a relay having a coil consisting of two electrically separated and capacitively coupled windings to confine the period of current flow. This known relay, however, is intended to be driven by d.c. voltage, and it is the purpose of the capacity to ensure that the magnetic flux required for exciting the relay is reached only shortly, i.e. only at the moment the relay is switched on or switched over. Once the capacity is charged, it prevents any further d.c. current flow. If the relay known from German Offenlegungsschrift No. 2 749 732 referred to above were used in the circuit known from German Auslegeschrift No. 1 298 626 also referred to above, again no permanent electromagnetic flux through the relay would be achieved upon switching-on the a.c. voltage. Instead, the rectifying effect of the diode bridge in connection with the d.c. behaviour of the capacity between the two windings, only one short charging of this capacity resulting in one short electromagnetic flux would be obtained.

SUMMARY OF THE INVENTION

It is an object of the present invention to devise an electromagnetic relay which is adapted to be driven by a.c. voltages, particularly higher a.c. voltages, such as 110 or 220 V, without consuming substantial exciting energy.

It is a further object of the invention to provide a relay which is adapted to be driven by higher a.c. voltages and which requires only little space.

As a further object of the present invention, an electromagnetic relay is to be provided which is adapted for being driven by a.c. voltage and in which the consumption of active energy by the relay coil is negligible in comparison to that of reactive energy.

In view of the above and other objects, the present invention provides an electromagnetic relay adapted to be driven from an a.c. voltage source and comprising (a) a coil having first and second electrically insulated, capacitively coupled windings, (b) a first pair of diodes connected in opposite forward directions between the respective ends of said first winding and a first terminal of said a.c. voltage source, and a second pair of diodes connected in opposite forward directions between the respective ends of said second winding and a second terminal of said a.c. voltage source, so that the magnetic fluxes generated by said first and second windings have the same directon irrespective of the polarity of the a.c. voltage, and (c) a contact system including at least one fixed contact and one movable contact adapted to be moved by said magnetic fluxes.

A relay is thus provided which requires little exciting energy due to having coil windings of low ohmic resistance, the exciting current being confined to a relatively small value by the capacity existing between the coil windings. As a result of the low consumption of active exciting energy, the relay will not be heated to any substantial degree. Since no additional circuit element is required, the relay will require only little space. The reactive resistance resulting from the capacity between the coil windings at the respective frequency of the applied a.c. voltage has a substantially greater absolute value than the ohmic resistance of the coil windings and may therefore be disregarded in an approximate calculation of the current required to energize the relay. As a result, the magnetic flux or number of ampere-turns necessary to excite the magnetic system is obtained by a coil having a given number of turns by making the capacity between the coil windings so large that their reactive resistance permits a sufficient current flow at the frequency of the voltage applied.

In a preferred embodiment of the invention, the exciting voltage U is defined so as to satisfy substantially the following equation:

$$U = \frac{\theta}{w}\sqrt{R^2 + \frac{1}{\omega^2 C^2}} \approx \frac{\theta}{w \cdot \omega C}$$

wherein $\theta$ is the magnetic flux required for exciting the relay, w is the number of turns of one coil, $\omega$ is the angular frequency of the applied a.c. voltage U, C is the capacity between the two coil windings, and R is the ohmic resistance of one coil winding.

In this approximate formula, which is sufficiently precise for practical applications, the coil inductivity has been disregarded because only an oscillating d.c. current is effective for the inductivity defined by the coil windings. The ohmic resistance of the coil windings is also negligible in practice in comparison with the substantially larger series-connected capacitive reactance resulting from the capacitive coupling between the coil windings. The required magnetic flux $\theta$ is a known constant for the respective magnetic system. Accordingly, the exciting voltage of the relay may be decreased by increasing the frequency of the a.c. voltage, increasing the capacity between the coil voltages, or similar measures.

In a further preferred embodiment of the invention, the first and second coil windings may be formed by coiling two wires together, wherein the said capacity is constituted by the winding capacity between the two wires. In such a two-wire coil winding, which may also be referred to as a bifilar winding, the beginnings and ends of the two windings are respectively adjacent. A coil of this type provides substantially larger capacity values than layered windings. The capacity of this two-wire coil may be further increased by reducing the wire diameter.

In a further embodiment of the invention, a surge voltage protection element, for instance a varistor or a bipolar Zener diode, may be connected between the a.c. voltage terminals. It is furthermore advantageous to arrange such Zener diode and the two pairs of diodes so as to form one structural unit. The coil windings and simultaneously the diodes are thus protected by inexpensive circuit means against any surge voltages that may occur.

In a further preferred embodiment, the relay of the present invention is used in a magnetic system in which the electromagnetic flux produced by the relay coil is superimposed by a permanent magnetic flux. The sensitivity of the relay is thereby considerably enhanced. A.c. relays can thus be realized in miniature design with the same requirements of exciting energy as applies to the d.c. relays referred to above.

It is also possible in a permanent magnetic system of this type that part of the permanent magnetic force is stored in contact springs of the relay. In addition to a further increase of the excitation sensitivity of the relay, this provides the possibility to render the exciting energy of the relay independent of the contact force or from the number of contact springs to be actuated, within the limits of the permanent magnetic force available.

BRIEF DESCRIPTION OF THE DRAWINGS

FIG. 1 is a circuit diagram showing the connection of the coil windings in a relay according to the present invention.

FIGS. 2 and 3 are diagrams for explaining the current paths existing at the two opposite polarities of the a.c. voltage applied.

FIG. 4 represents the arrangement of certain circuit elements to form one common structural unit.

FIG. 5 shows the relative positions of the windings in a relay according to the present invention.

DESCRIPTION OF A PREFERRED EMBODIMENT

FIGS. 1 to 3 and 5 represent coil windings W1, W2 of an electromagnetic relay, which are connected to the terminals 5, 6 of an a.c. voltage source U via rectifying diodes D1 to D4. The two coil windings W1, W2 are electrically separated and formed in one manufacturing step by winding two wires in the same coiling sense. The coils in FIGS. 1–3 are shown schematically and the actual winding configuration is shown in FIG. 5. First diodes D1, D3 have their cathodes connected to the adjacent winding beginnings 1, 3, and second diodes D2, D4, have their anodes connected to the adjacent winding ends 2, 4. The terminals of the diodes D1 and D2 remote from the winding W1 are in common connected to the voltage terminal 5, and the terminals of the diodes D3 and D4 remote from the winding W2 are in common connected to the voltage terminal 6. As shown in FIGS. 1–3, a voltage limiting element Z, such as a bipolar Zener diode, is connected between the terminals 5, 6 to protect the windings W1, W2 and the diodes D1 to D4 from surge voltages. Fixed and movable contacts C1 and C2 are positioned close to windings W1, W2 and are operated by the magnetic flux produced thereby. FIG. 4 shows the arrangement and interconnection of the Zener diode Z with the four diodes D1 to D4 in one common structural unit.

Due to the connection of the coil windings W1, W2, with the diodes D1 to D4, the current J always flows in the same direction through both windings, independent of the polarity of the applied a.c. voltage U, while the current flowing through the capacity C formed between the two windings W1, W2 is reversed in accordance with the polarity of a.c. voltage. Since the capacity in the present embodiment is constituted by the winding capacity of the two-wire coil rather than by a discrete capacitive element, the actual winding configuration is shown only in FIG. 5 and the windings in FIGS. 1–3 are shown schematically with the capacitance between the windings shown in phantom lines. When the a.c. voltage has the polarity as shown in FIG. 2, i.e. when the terminal 5 is on positive potential and the terminal 6 on negative potential, the exciting current J flows from the positive terminal 5 through the first diode D1 to the beginning 1 of the coil winding W1, through the winding capacity C and the winding W2 to the end 4 of this winding and further through the second diode D4 to the negative terminal 6. With this polarity of the a.c. voltage U, the diodes D2 and D3 are non-conductive. When the polarity of the voltage U is changed as shown in FIG. 3, the exciting current J now flows from the positive terminal 6 through the first diode D3 to the beginning 3 of the winding W2, through the winding capacity C, the winding W1 to the end 2 thereof and further through the second diode D2 to the negative terminal 5. In this case, the diodes D1 and D4 are reversely biassed and non-conducting. While the coil windings W1 and W2 carry current always in the same direction, a.c. current flows through the winding capacity which couples the two windings. To achieve the exciting voltage U desired for the relay, the capacity C and the number of turns w of each coil winding W1, W2 are selected in accordance with the above equation.

The required magnetic flux is given and known for the respective magnetic system employed. In the approximate equation recited, the ohmic coil resistance is negligible when its absolute value is substantially below that of the reactance resulting from the winding capacity. The capacity values for adjacent coil wires are also known, so that the winding capacity of a two-wire coil may be calculated with good approximation.

To provide an example, a winding capacity of 30 nF is achieved in a modern miniature relay having a two-wire coil of 10,000 turns. A permanent excitation of the relay with an a.c. voltage of 220 V results in a self-heating of about 10° C., which means that such a relay may be inserted in any circuit without any problems, just as modern polarized relays.

I claim:

1. An electromagnetic relay adapted to be driven from an a.c. voltage source, comprising (a) a coil having first and second electrically insulated, capacitively coupled windings, (b) a first pair of diodes connected in opposite forward directions between the respective ends of said first winding and a first terminal of said a.c. voltage source, and a second pair of diodes connected in opposite forward directions between the respective ends of said second winding and a second terminal of said a.c. voltage source, so that the magnetic fluxes generated by said first and second windings have the same direction irrespective of the polarity of the a.c. voltage, and (c) a contact system including at least one fixed contact and one movable contact adapted to be moved by said magnetic fluxes.

2. The relay of claim 1, wherein the a.c. voltage required to move said movable contact satisfies substantially the following equation:

$$U = \frac{\theta}{w}\sqrt{R^2 + \frac{1}{\omega^2 C^2}} \simeq \frac{\theta}{w \cdot \omega C}$$

wherein $\theta$ is the sum of said magnetic fluxes required to move said movable contact, w is the number of turns of each of said first and second windings, $\omega$ is the angular frequency of said a.c. voltage, C is the capacity between said first and second windings, and R is the ohmic resistance of each of said first and second windings, 3. The relay of claim 2, wherein said first and second windings are formed by coiling two wires together, said capacity being constituted by the winding capacity between said wires.

4. The relay of claim 1, including means for protecting said first and second windings against surge voltages.

5. The relay of claim 4, wherein said protecting means includes a bipolar Zener diode connected between said first and second terminals.

6. The relay of claim 5, wherein said Zener diode and said first and second pairs of diodes are formed as a common unit.

* * * * *